US008322446B2

(12) United States Patent
Smithson et al.

(10) Patent No.: US 8,322,446 B2
(45) Date of Patent: Dec. 4, 2012

(54) REMOTE ACTUATION OF DOWNHOLE WELL TOOLS

(75) Inventors: Mitchell C. Smithson, Pasadena, TX (US); Timothy R. Tips, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 243 days.

(21) Appl. No.: 12/555,451

(22) Filed: Sep. 8, 2009

(65) Prior Publication Data

US 2010/0059233 A1 Mar. 11, 2010

(30) Foreign Application Priority Data

Sep. 9, 2008 (WO) ..... PCT/US2008/075668

(51) Int. Cl.
*E21B 23/00* (2006.01)
*E21B 34/06* (2006.01)

(52) U.S. Cl. ..... 166/373; 166/66.5; 166/66.6; 166/381

(58) Field of Classification Search ..... 166/374, 166/65.1, 66.5, 373, 381, 66.6, 53
See application file for complete search history.

(56) References Cited

U.S. PATENT DOCUMENTS 3,427,580 A 2/1969 Brock
3,430,712 A 3/1969 Stafford
3,565,189 A * 2/1971 Hart ..... 175/24
3,575,650 A 4/1971 Fengler
3,717,095 A * 2/1973 Vann ..... 102/320
3,906,328 A 9/1975 Wenrich et al.
4,138,669 A 2/1979 Edison et al.
4,178,020 A 12/1979 Dopyera
4,467,833 A 8/1984 Satterwhite
4,765,184 A 8/1988 Delatorre
5,156,220 A 10/1992 Forehand et al.
5,251,703 A 10/1993 Skinner
5,547,029 A 8/1996 Rubbo et al.
5,868,201 A 2/1999 Bussear et al.
5,896,076 A 4/1999 Van Namen
6,179,052 B1 1/2001 Purkis et al.
6,247,536 B1 6/2001 Leismer et al.
6,315,049 B1 11/2001 Hickey et al.
6,464,011 B2 10/2002 Tubel (Continued)

OTHER PUBLICATIONS

Australian Office Action issued Feb. 4, 2010, for Australian Patent Application Serial No. 2006336428, 2 pages.

(Continued)

*Primary Examiner* — Daniel P Stephenson
*Assistant Examiner* — Catherine Loikith
(74) *Attorney, Agent, or Firm* — Smith IP Services, P.C.

(57) ABSTRACT

A method of selectively actuating well tools includes the steps of: selecting a well tool for actuation by current flow in one direction through a set of conductors; and selecting another well tool for actuation by opposite current flow through the set of conductors. A system includes multiple control devices that control which well tool is selected for actuation in response to current flow in at least one conductor set. A current direction in the conductors selects a certain well tool for actuation. A method of using n conductors to selectively actuate n*(n−1) well tools includes the steps of: arranging the conductors into n*(n−1)/2 sets; connecting the conductor sets to respective groups of the well tools; and controlling direction of current flow through at least one of the sets of conductors, thereby selecting at least one well tool in the respective group of the well tools for actuation.

21 Claims, 10 Drawing Sheets

U.S. PATENT DOCUMENTS

| | | | | |
|---|---|---|---|---|
| 6,470,970 | B1 | 10/2002 | Purkis et al. | |
| 6,567,013 | B1 | 5/2003 | Purkis et al. | |
| 6,575,237 | B2 | 6/2003 | Purkis et al. | |
| 6,585,051 | B2 | 7/2003 | Purkis et al. | |
| 6,668,936 | B2 | 12/2003 | Williamson, Jr. et al. | |
| 6,736,213 | B2 | 5/2004 | Bussear et al. | |
| 6,782,952 | B2 | 8/2004 | Garay et al. | |
| 6,796,213 | B1 | 9/2004 | McKendree et al. | |
| 7,145,471 | B2 | 12/2006 | Purkins et al. | |
| 2001/0037884 | A1 | 11/2001 | Schultz et al. | |
| 2002/0014338 | A1 | 2/2002 | Purkis et al. | |
| 2003/0048197 | A1 | 3/2003 | Purkis et al. | |
| 2003/0131990 | A1 | 7/2003 | Tubel et al. | |
| 2011/0067854 | A1* | 3/2011 | Love et al. | 166/55.1 |

OTHER PUBLICATIONS

Canadian Office Action issued Nov. 18, 2009, for Canadian Patent Application Serial No. 2,637,326, 3 pages.

International Preliminary report on Patentability issued Mar. 24, 2011, for International Patent Application No. PCT/US09/056339, 7 pages.

International Preliminary Report on Patentability issued Mar. 24, 2011, for International Patent Application No. PCT/US09/046363, 7 pages.

International Preliminary Report on Patentability issued Mar. 24, 2011, for International Patent Application No. PCT/US08/075668, 6 pages.

International Search Report and Written Opinion issued May 7, 2007, for International Patent Application Serial No. PCT/US06/02304, 6 pages.

International Search Report and Written Opinion issued May 26, 2009, for International Patent Application Serial No. PCT/US08/75668, 11 pages.

Lee Flosert Constant Flow Rate Product Brochure, Dec. 2002, 1 page.

Office Action issued Jun. 24, 2009, for U.S. Appl. No. 11/626,033, 23 pages.

International Search Report and Written Opinion issued Jul. 27, 2009, for International Patent Application Serial No. PCT/US09/46363, 8 pages.

International Search Report and Written Opinion issued Jul. 27, 2009, for International Patent Application Serial No. PCT/US09/46404, 8 pages.

U.S. Appl. No. 12/390,758, filed Feb. 23, 2009, 31 pages.

Office Action issued Dec. 17, 2009, for U.S. Appl. No. 11/626,033, 10 pages.

International Search Report and Written Opinion issued Oct. 21, 2009, for International Patent Application Serial No. PCT/US09/56339, 8 pages.

Australian Examination Report issued Aug. 8, 2012 for AU Patent Application No. 2008349827, 4 pages.

Office Action issued May 21, 2012 for U.S. Appl. No. 12/792,402, 29 pages.

* cited by examiner

REMOTE ACTUATION OF DOWNHOLE WELL TOOLS

CROSS-REFERENCE TO RELATED APPLICATION

The present application claims the benefit under 35 USC §119 of the filing date of International Application No. PCT/US08/75668, filed Sep. 9, 2008. The entire disclosure of this prior application is incorporated herein by this reference.

BACKGROUND

The present disclosure relates generally to operations performed and equipment utilized in conjunction with a subterranean well and, in an embodiment described herein, more particularly provides for remote actuation of downhole well tools.

It is useful to be able to selectively actuate well tools in a subterranean well. For example, production flow from each of multiple zones of a reservoir can be individually regulated by using a remotely controllable choke for each respective zone. The chokes can be interconnected in a production tubing string so that, by varying the setting of each choke, the proportion of production flow entering the tubing string from each zone can be maintained or adjusted as desired.

Unfortunately, this concept is more complex in actual practice. In order to be able to individually actuate multiple downhole well tools, a relatively large number of wires, lines, etc. have to be installed and/or complex wireless telemetry and downhole power systems need to be utilized. Each of these scenarios involves use of relatively unreliable downhole electronics and/or the extending and sealing of many lines through bulkheads, packers, hangers, wellheads, etc.

Therefore, it will be appreciated that advancements in the art of remotely actuating downhole well tools are needed. Such advancements would preferably reduce the number of lines, wires, etc. installed, and would preferably reduce or eliminate the need for downhole electronics.

SUMMARY

In carrying out the principles of the present disclosure, systems and methods are provided which solve at least one problem in the art. One example is described below in which a relatively large number of well tools may be selectively actuated using a relatively small number of lines, wires, etc. Another example is described below in which a direction of current flow through a set of conductors is used to select which of two respective well tools is to be actuated.

In one aspect, a method of selectively actuating multiple downhole well tools from a remote location is provided. The method includes the steps of: selecting one of the well tools for actuation by flowing electrical current in one direction through a set of conductors in the well; and selecting another one of the well tools for actuation by flowing electrical current through the set of conductors in an opposite direction.

In another aspect, a system for selectively actuating multiple downhole well tools from a remote location includes multiple electrical conductors in the well; and multiple control devices that control which of the well tools is selected for actuation in response to current flow in at least one set of the conductors. At least one direction of current flow in the at least one set of conductors is operative to select a respective at least one of the well tools for actuation.

In yet another aspect, a method of using n conductors to selectively actuate n*(n−1) downhole well tools includes the steps of: arranging the n conductors into n*(n−1)/2 sets of conductors; connecting each set of conductors to a respective group of the well tools; and controlling direction of current flow through at least one of the sets of conductors, thereby selecting at least one well tool in the respective group of the well tools for actuation.

One of the conductors may be a tubular string extending into the earth, or in effect "ground."

These and other features, advantages, benefits and objects will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

It is to be understood that the various embodiments of the present disclosure described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

In the following description of the representative embodiments of the disclosure, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
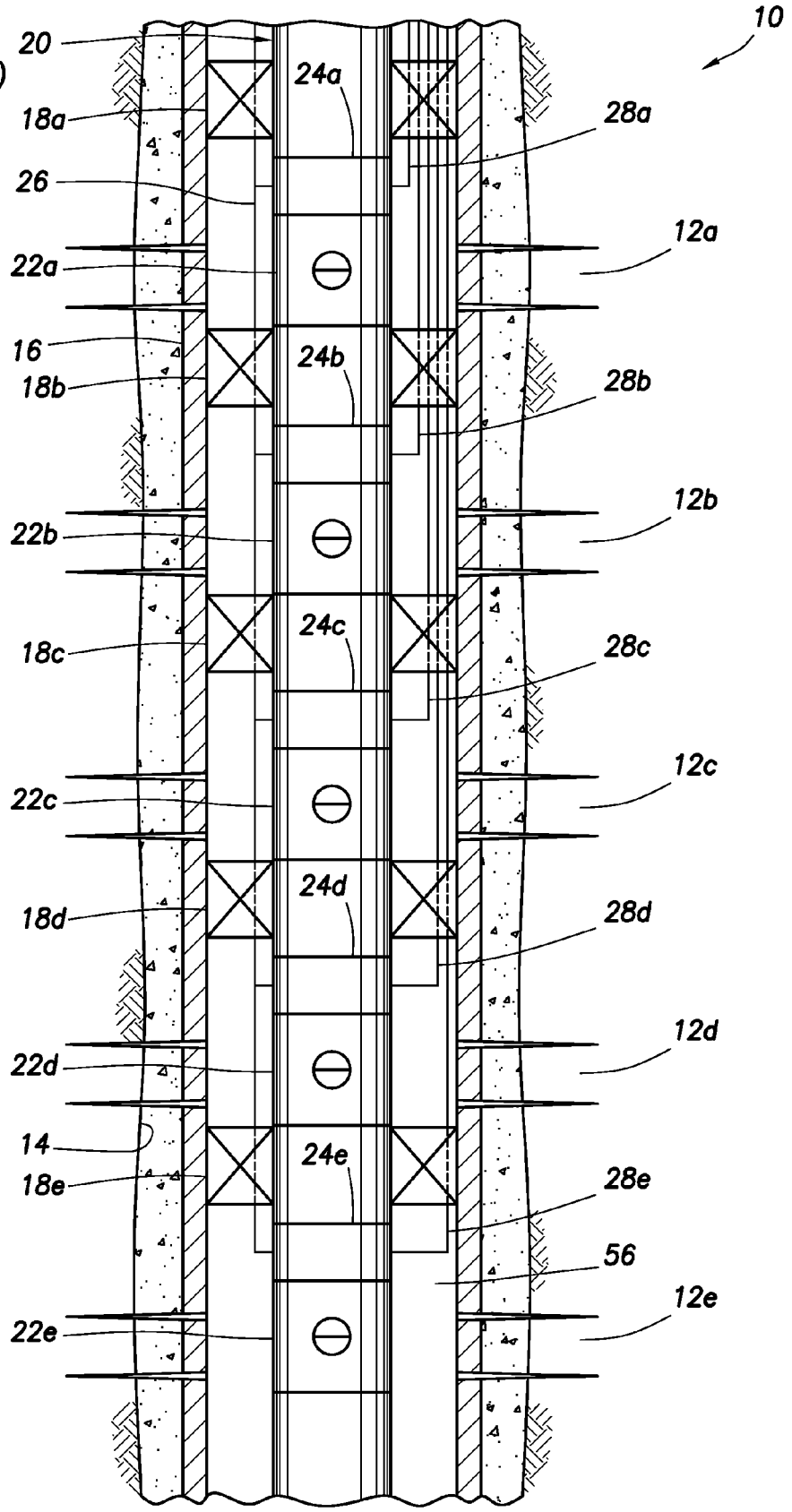
FIG. 1 (PRIOR ART)
FIG. 1 is a schematic view of a prior art well control system.

Representatively illustrated in FIG. 1 is a well control system 10 which is used to illustrate the types of problems overcome by the systems and methods of the present disclosure. Although the drawing depicts prior art concepts, it is not meant to imply that any particular prior art well control system included the exact configuration illustrated in FIG. 1.

The control system 10 as depicted in FIG. 1 is used to control production flow from multiple zones 12*a-e* intersected by a wellbore 14. In this example, the wellbore 14 has been cased and cemented, and the zones 12*a-e* are isolated within a casing string 16 by packers 18*a-e* carried on a production tubing string 20.

Fluid communication between the zones 12*a-e* and the interior of the tubing string 20 is controlled by means of flow control devices 22*a-e* interconnected in the tubing string. The flow control devices 22*a-e* have respective actuators 24*a-e* for actuating the flow control devices open, closed or in a flow choking position between open and closed.

In this example, the control system 10 is hydraulically operated, and the actuators 24*a-e* are relatively simple piston-and-cylinder actuators. Each actuator 24*a-e* is connected to two hydraulic lines—a balance line 26 and a respective one of multiple control lines 28*a-e*. A pressure differential between the balance line 26 and the respective control line 28*a-e* is applied from a remote location (such as the earth's surface, a subsea wellhead, etc.) to displace the piston of the corresponding actuator 24*a-e* and thereby actuate the associated flow control device 22*a-e*, with the direction of displacement being dependent on the direction of the pressure differential.

There are many problems associated with the control system 10. One problem is that a relatively large number of lines 26, 28*a-e* are needed to control actuation of the devices 22*a-e*. These lines 26, 28*a-e* must extend through and be sealed off at the packers 18*a-e*, as well as at various bulkheads, hangers, wellhead, etc.

Another problem is that it is difficult to precisely control pressure differentials between lines extending perhaps a thousand or more meters into the earth. This will lead to improper or unwanted actuation of the devices 22*a-e*, as well as imprecise regulation of flow from the zones 12*a-e*.

Attempts have been made to solve these problems by using downhole electronic control modules for selectively actuating the devices 22*a-e*. However, these control modules include sensitive electronics which are frequently damaged by the hostile downhole environment (high temperature and pressure, etc.).

Furthermore, electrical power must be supplied to the electronics by specialized high temperature batteries, by downhole power generation or by wires which (like the lines 26, 28*a-e*) must extend through and be sealed at various places in the system. Signals to operate the control modules must be supplied via the wires or by wireless telemetry, which includes its own set of problems.

Thus, the use of downhole electronic control modules solves some problems of the control system 10, but introduces other problems. Likewise, mechanical and hydraulic solutions have been attempted, but most of these are complex, practically unworkable or failure-prone.

Figure 2:
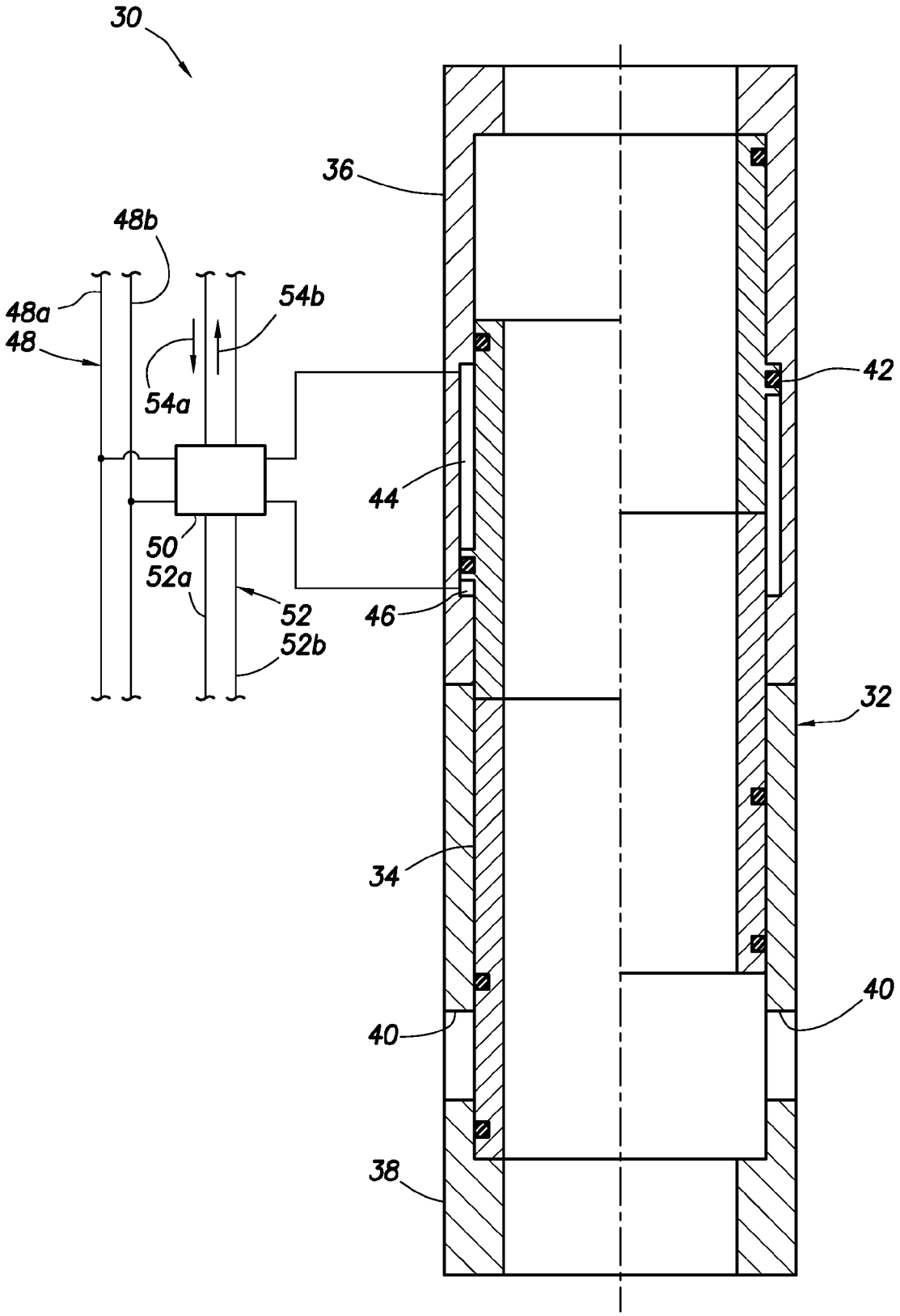
FIG. 2 is an enlarged scale schematic view of a flow control device and associated control device which embody principles of the present disclosure.

Turning now to FIG. 2, a system 30 and associated method for selectively actuating multiple well tools 32 are representatively illustrated. Only a single well tool 32 is depicted in FIG. 2 for clarity of illustration and description, but the manner in which the system 30 may be used to selectively actuate multiple well tools is described more fully below.

The well tool 32 in this example is depicted as including a flow control device 38 (such as a valve or choke), but other types or combinations of well tools may be selectively actuated using the principles of this disclosure, if desired. A sliding sleeve 34 is displaced upwardly or downwardly by an actuator 36 to open or close ports 40. The sleeve 34 can also be used to partially open the ports 40 and thereby variably restrict flow through the ports.

The actuator 36 includes an annular piston 42 which separates two chambers 44, 46. The chambers 44, 46 are connected to lines 48*a,b* via a control device 50. D.C. current flow in a set of electrical conductors 52*a,b* is used to select whether the well tool 32 is to be actuated in response to a pressure differential between the lines 48*a,b*.

In one example, the well tool 32 is selected for actuation by flowing current between the conductors 52*a,b* in a first direction 54*a* (in which case the chambers 44, 46 are connected to the lines 48*a,b*), but the well tool 32 is not selected for actuation when current flows between the conductors 52*a,b* in a second, opposite, direction 54*b* (in which case the chambers 44, 46 are isolated from the lines 48*a,b*). Various configurations of the control device 50 are described below for accomplishing this result. These control device 50 configurations are advantageous in that they do not require complex, sensitive or unreliable electronics or mechanisms, but are instead relatively simple, economical and reliable in operation.

The well tool 32 may be used in place of any or all of the flow control devices 22*a-e* and actuators 24*a-e* in the system 10 of FIG. 1. Suitably configured, the principles of this disclosure could also be used to control actuation of other well tools, such as selective setting of the packers 18*a-e*, etc.

Note that the hydraulic lines 48*a,b* are representative of one type of fluid pressure source 48 which may be used in keeping with the principles of this disclosure. It should be understood that other fluid pressure sources (such as pressure within the tubing string 20, pressure in an annulus 56 between the tubing and casing strings 20, 16, pressure in an atmospheric or otherwise pressurized chamber, etc., may be used as fluid pressure sources in conjunction with the control device 50 for supplying pressure to the actuator 36 in other embodiments.

The conductors 52*a,b* comprise a set of conductors 52 through which current flows, and this current flow is used by the control device 50 to determine whether the associated well tool 32 is selected for actuation. Two conductors 52*a,b* are depicted in FIG. 2 as being in the set of conductors 52, but it should be understood that any number of conductors may be used in keeping with the principles of this disclosure. In addition, the conductors 52*a,b* can be in a variety of forms, such as wires, metal structures (for example, the casing or tubing strings 16, 20, etc.), or other types of conductors.

The conductors 52*a,b* preferably extend to a remote location (such as the earth's surface, a subsea wellhead, another location in the well, etc.). For example, a surface power supply and multiplexing controller can be connected to the conductors 52*a,b* for flowing current in either direction 54*a,b* between the conductors.

In the examples described below, n conductors can be used to selectively control actuation of n*(n−1) well tools. The benefits of this arrangement quickly escalate as the number of well tools increases. For example, three conductors may be used to selectively actuate six well tools, and only one additional conductor is needed to selectively actuate twelve well tools.

Figure 3:
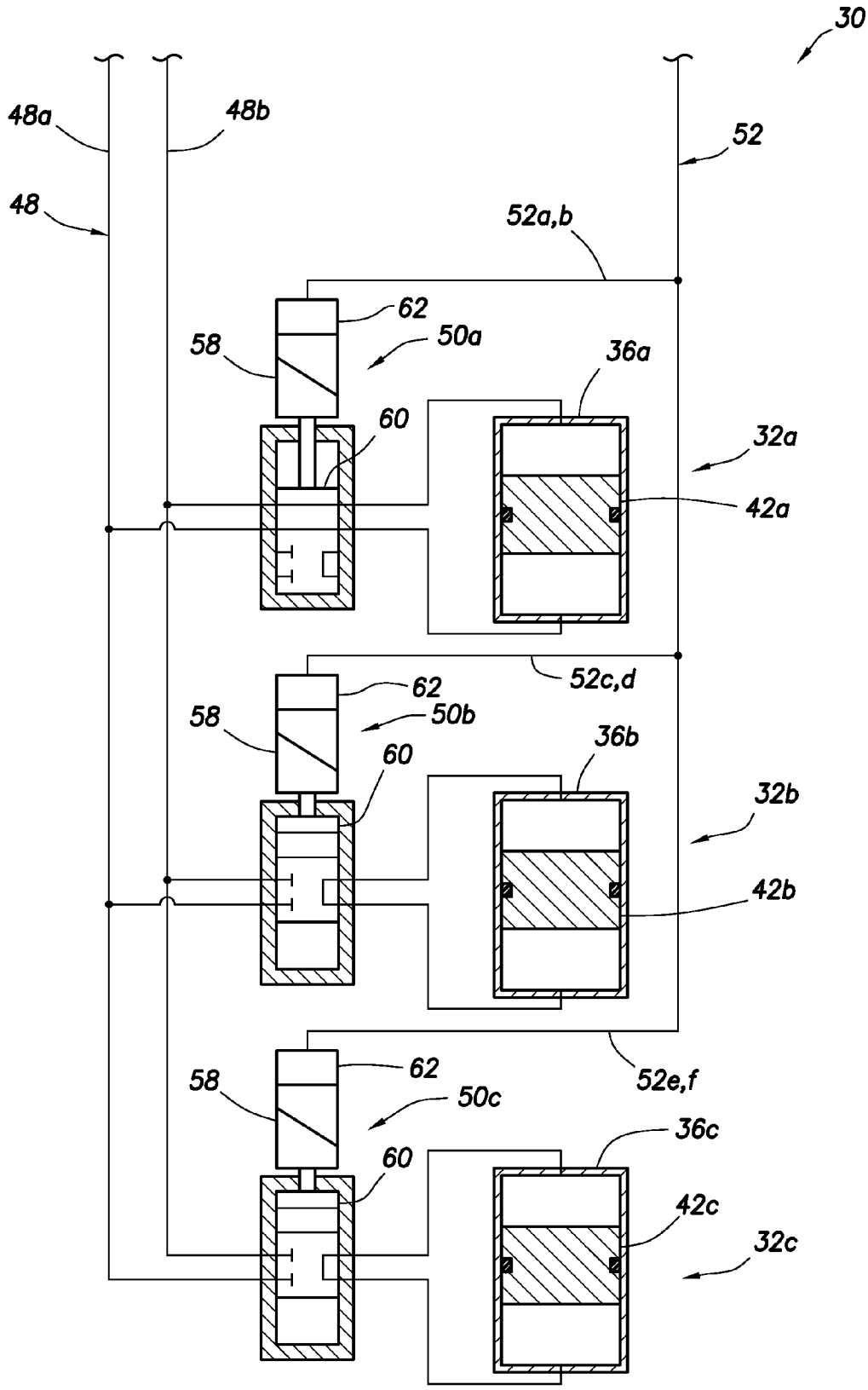
FIG. 3 is a schematic electrical and hydraulic diagram showing a system and method for remotely actuating multiple downhole well tools.

Referring additionally now to FIG. 3, a somewhat more detailed illustration of the electrical and hydraulic aspects of one example of the system 30 are provided. In addition, FIG.

3 provides for additional explanation of how multiple well tools 32 may be selectively actuated using the principles of this disclosure.

In this example, multiple control devices 50*a-c* are associated with respective multiple actuators 36*a-c* of multiple well tools 32*a-c*. The actuators 36*a-c* include pistons 42*a-c*. It should be understood that any number of control devices, actuators and well tools may be used in keeping with the principles of this disclosure, and that these elements may be combined, if desired (for example, multiple control devices could be combined into a single device, a single well tool can include multiple functional well tools, an actuator and/or control device could be built into a well tool, etc.).

Each of the control devices 50*a-c* depicted in FIG. 3 includes a solenoid actuated spool valve. A solenoid 58 of the control device 50*a* has displaced a spool or poppet valve 60 to a position in which the actuator 36*a* is now connected to the lines 48*a,b*. A pressure differential between the lines 48*a,b* can now be used to displace the piston 42*a* and actuate the well tool 32*a*. The remaining control devices 50*b,c* prevent actuation of their associated well tools 32*b,c* by isolating the lines 48*a,b* from the actuators 36*b,c*.

The control device 50*a* responds to current flow through a certain set of the conductors 52. In this example, conductors 52*a,b* are connected to the control device 50*a*. When current flows in one direction through the conductors 52*a,b*, the control device 50*a* causes the actuator 36*a* to be operatively connected to the lines 48*a,b*, but when current flows in an opposite direction through the conductors, the control device causes the actuator to be operatively isolated from the lines.

As depicted in FIG. 3, the other control devices 50*b,c* are connected to different sets of the conductors 52. For example, control device 50*b* is connected to conductors 52*c,d* and control device 50*c* is connected to conductors 52*e,f*.

When current flows in one direction through the conductors 52*c,d*, the control device 50*b* causes the actuator 36*b* to be operatively connected to the lines 48*a,b*, but when current flows in an opposite direction through the conductors, the control device causes the actuator to be operatively isolated from the lines. Similarly, when current flows in one direction through the conductors 52*e,f*, the control device 50*c* causes the actuator 36*c* to be operatively connected to the lines 48*a,b*, but when current flows in an opposite direction through the conductors, the control device causes the actuator to be operatively isolated from the lines.

However, it should be understood that multiple control devices are preferably, but not necessarily, connected to each set of conductors. By connecting multiple control devices to the same set of conductors, the advantages of a reduced number of conductors can be obtained, as explained more fully below.

The function of selecting a particular well tool 32*a-c* for actuation in response to current flow in a particular direction between certain conductors is provided by directional elements 62 of the control devices 50*a-c*. Various different types of directional elements 62 are described more fully below.

Figure 4:
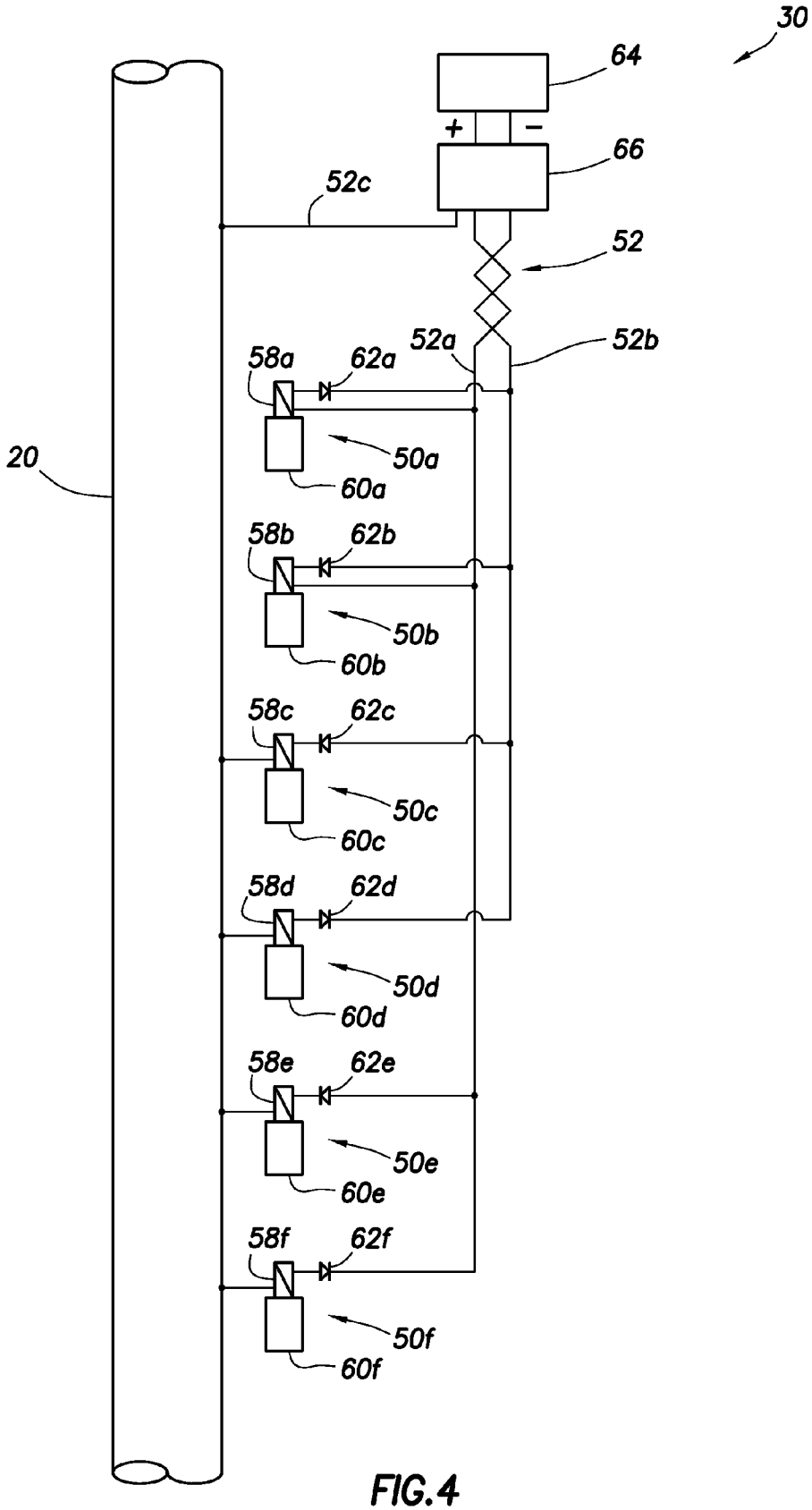
FIG. 4 is a schematic electrical diagram showing another configuration of the system and method for remotely actuating multiple downhole well tools.

Referring additionally now to FIG. 4, an example of the system 30 is representatively illustrated, in which multiple control devices are connected to each of multiple sets of conductors, thereby achieving the desired benefit of a reduced number of conductors in the well. In this example, actuation of six well tools may be selectively controlled using only three conductors, but, as described herein, any number of conductors and well tools may be used in keeping with the principles of this disclosure.

As depicted in FIG. 4, six control devices 50*a-f* are illustrated apart from their respective well tools. However, it will be appreciated that each of these control devices 50*a-f* would in practice be connected between the fluid pressure source 48 and a respective actuator 36 of a respective well tool 32 (for example, as described above and depicted in FIGS. 2 & 3).

The control devices 50*a-f* include respective solenoids 58*a-f*, spool valves 60*a-f* and directional elements 62*a-f*. In this example, the elements 62*a-f* are diodes. Although the solenoids 58*a-f* and diodes 62*a-f* are electrical components, they do not comprise complex or unreliable electronic circuitry, and suitable reliable high temperature solenoids and diodes are readily available.

A power supply 64 is used as a source of direct current. The power supply 64 could also be a source of alternating current and/or command and control signals, if desired. However, the system 30 as depicted in FIG. 4 relies on directional control of current in the conductors 52 in order to selectively actuate the well tools 32, so alternating current, signals, etc. should be present on the conductors only if such would not interfere with this selection function. If the casing string 16 and/or tubing string 20 is used as a conductor in the system 30, then preferably the power supply 64 comprises a floating power supply.

The conductors 52 may also be used for telemetry, for example, to transmit and receive data and commands between the surface and downhole well tools, actuators, sensors, etc. This telemetry can be conveniently transmitted on the same conductors 52 as the electrical power supplied by the power supply 64.

The conductors 52 in this example comprise three conductors 52*a-c*. The conductors 52 are also arranged as three sets of conductors 52*a,b* 52*b,c* and 52*a,c*. Each set of conductors includes two conductors. Note that a set of conductors can share one or more individual conductors with another set of conductors.

Each conductor set is connected to two control devices. Thus, conductor set 52*a,b* is connected to each of control devices 50*a,b*, conductor set 52*b,c* is connected to each of control devices 50*c,d*, and conductor set 52*a,c* is connected to each of control devices 50*e,f*.

In this example, the tubing string 20 is part of the conductor 52*c*. Alternatively, or in addition, the casing string 16 or any other conductor can be used in keeping with the principles of this disclosure.

It will be appreciated from a careful consideration of the system 30 as depicted in FIG. 4 (including an observation of how the diodes 62*a-f* are arranged between the solenoids 58*a-f* and the conductors 52*a-c*) that different current flow directions between different conductors in the different sets of conductors can be used to select which of the solenoids 58*a-f* are powered to thereby actuate a respective well tool. For example, current flow from conductor 52*a* to conductor 52*b* will provide electrical power to solenoid 58*a* via diode 62*a*, but oppositely directed current flow from conductor 52*b* to conductor 52*a* will provide electrical power to solenoid 58*b* via diode 62*b*. Conversely, diode 62*a* will prevent solenoid 58*a* from being powered due to current flow from conductor 52*b* to conductor 52*a*, and diode 62*b* will prevent solenoid 58*b* from being powered due to current flow from conductor 52*a* to conductor 52*b*.

Similarly, current flow from conductor 52*b* to conductor 52*c* will provide electrical power to solenoid 58*c* via diode 62*c*, but oppositely directed current flow from conductor 52*c* to conductor 52*b* will provide electrical power to solenoid 58*d* via diode 62*d*. Diode 62*c* will prevent solenoid 58*c* from being powered due to current flow from conductor 52*c* to conductor 52*b*, and diode 62*d* will prevent solenoid 58*d* from being powered due to current flow from conductor 52*b* to conductor 52*c*.

Current flow from conductor 52*a* to conductor 52*c* will provide electrical power to solenoid 58*e* via diode 62*e*, but oppositely directed current flow from conductor 52*c* to conductor 52*a* will provide electrical power to solenoid 58*f* via diode 62*f*. Diode 62*e* will prevent solenoid 58*e* from being powered due to current flow from conductor 52*c* to conductor 52*a*, and diode 62*f* will prevent solenoid 58*f* from being powered due to current flow from conductor 52*a* to conductor 52*c*.

The direction of current flow between the conductors 52 is controlled by means of a switching device 66. The switching device 66 is interconnected between the power supply 64 and the conductors 52, but the power supply and switching device could be combined, or could be part of an overall control system, if desired.

Figure 5:
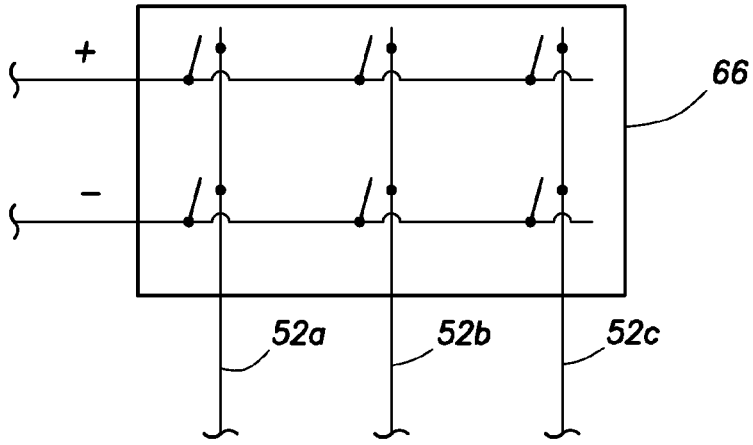
FIG. 5 is a schematic electrical diagram showing details of a switching arrangement which may be used in the system of FIG. 4.
Figure 6:
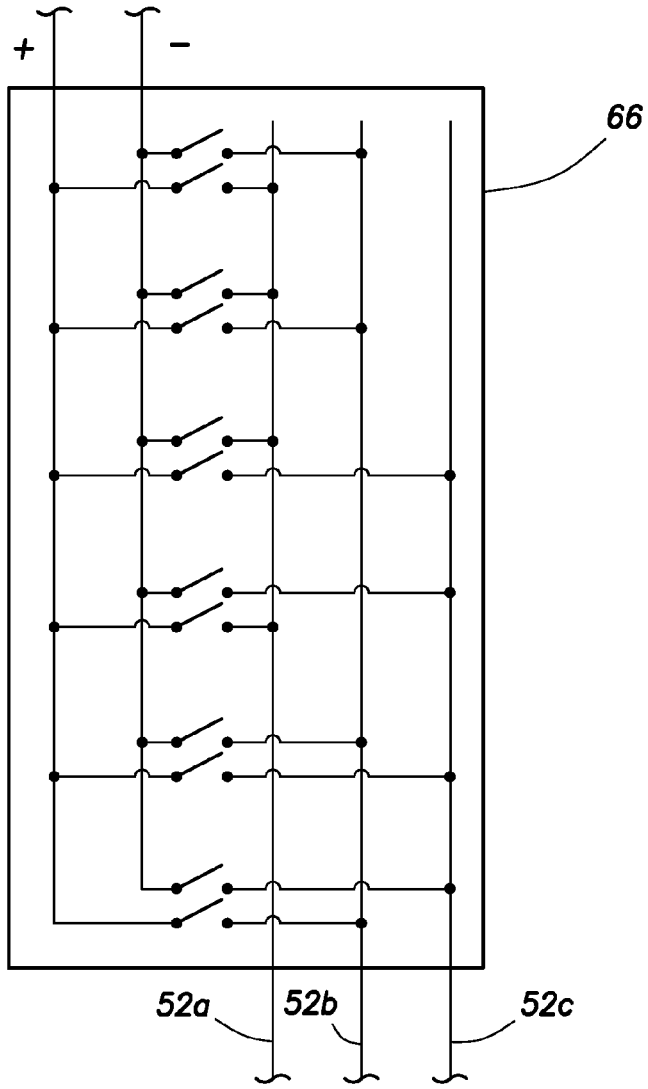
FIG. 6 is a schematic electrical diagram showing details of another switching arrangement which may be used in the system of FIG. 4.

Examples of different configurations of the switching device 66 are representatively illustrated in FIGS. 5 & 6. FIG. 5 depicts an embodiment in which six independently controlled switches are used to connect the conductors 52*a-c* to the two polarities of the power supply 64. FIG. 6 depicts an embodiment in which an appropriate combination of switches are closed to select a corresponding one of the well tools for actuation. This embodiment might be implemented, for example, using a rotary switch. Other implementations (such as using a programmable logic controller, etc.) may be utilized as desired.

Figure 7:
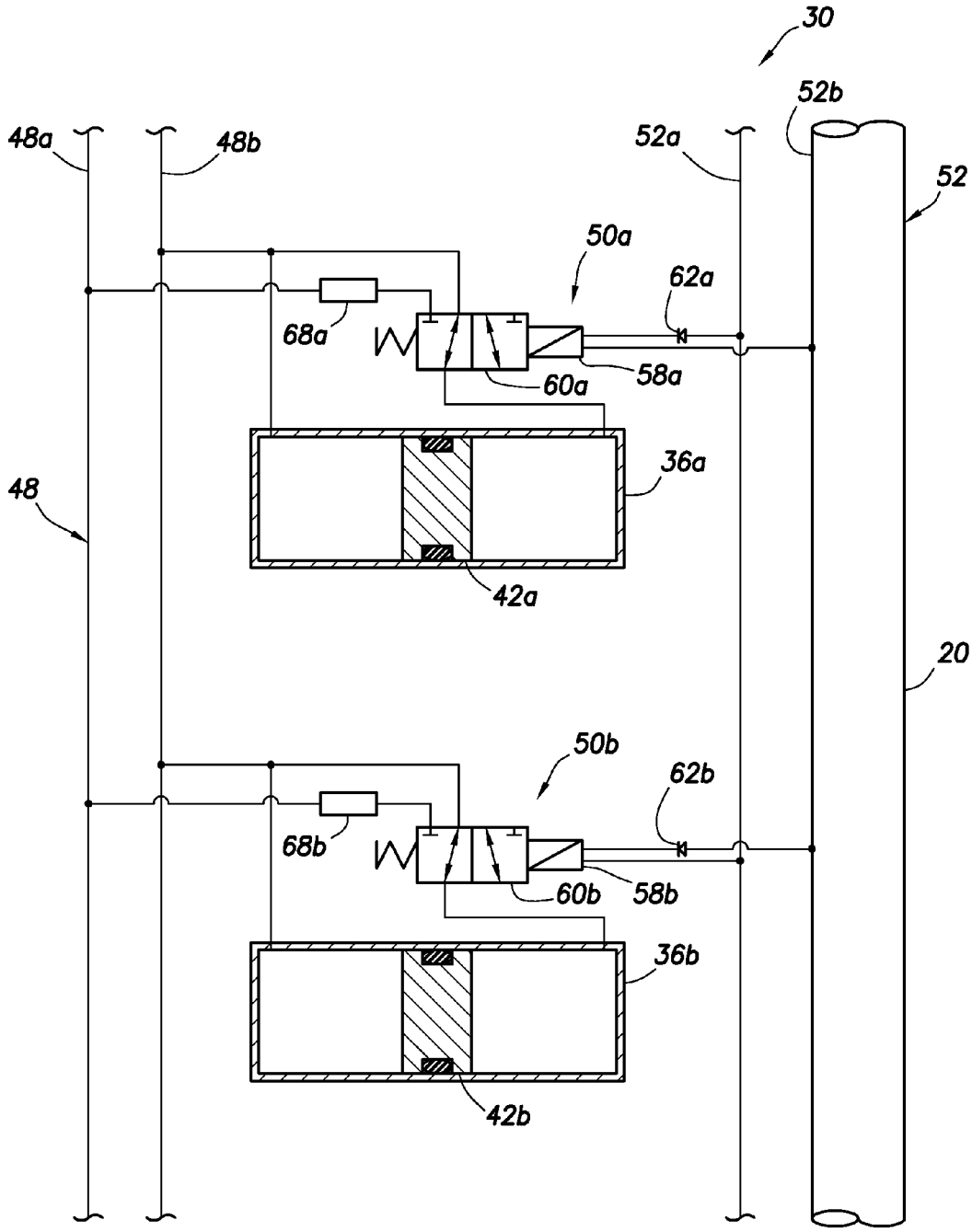
FIG. 7 is a schematic electrical and hydraulic diagram showing another configuration of the system and method for remotely actuating multiple downhole well tools.

Referring additionally now to FIG. 7, another configuration of the control system 30 is representatively illustrated. The configuration of FIG. 7 is similar in many respects to the configuration of FIG. 3. However, only two each of the actuators 36*a,b* and control devices 50*a,b*, and one set of conductors 52*a,b* are depicted in FIG. 7, it being understood that any number of actuators, control devices and sets of conductors may be used in keeping with the principles of this disclosure.

Another difference between the FIGS. 3 & 7 configurations is in the spool valves 60*a,b*. The spool valves 60 in the FIGS. 3 & 7 configurations accomplish similar results, but in somewhat different manners. In both configurations, the spool valves 60 pressure balance the pistons 42 when the solenoids 58 are not powered, and they connect the actuators 36 to the pressure source 48 when the solenoids 58 are powered. However, in the FIG. 3 configuration, the actuators 36 are completely isolated from the pressure source 48 when the solenoids 58 are not powered, whereas in the FIG. 7 configuration, the actuators remain connected to one of the lines 48*b* when the solenoids are not powered.

Another difference is that pressure-compensated flow rate regulators 68*a,b* are connected between the line 48*a* and respective spool valves 60*a,b*. The flow regulators 68*a,b* maintain a substantially constant flow rate therethrough, even though pressure differential across the flow regulators may vary. A suitable flow regulator for use in the system 30 is a FLOSERT(™) available from Lee Co. of Essex, Conn. USA.

When one of the solenoids 58*a,b* is powered and the respective piston 42*a* or *b* is being displaced in response to a pressure differential between the lines 48*a,b*, the flow regulator 68*a* or *b* will ensure that the piston displaces at a predetermined velocity, since fluid will flow through the flow regulator at a corresponding predetermined flow rate. In this manner, the position of the piston can be precisely controlled (i.e., by permitting the piston to displace at its predetermined velocity for a given amount of time, which can be precisely controlled via the control device due to the presence and direction of current flow in the conductors 52 as described above).

Although the flow regulators 68*a,b* are depicted in FIG. 7 as being connected between the line 48*a* and the respective spool valves 60*a,b*, it will be appreciated that other arrangements are possible. For example, the flow regulators 68*a,b* could be connected between the line 48*b* and the spool valves 60*a,b*, or between the spool valves and the actuators 36*a,b*, etc.

In addition, the flow regulators may be used in any of the other control system 30 configurations described herein, if desired, in order to allow for precise control of the positions of the pistons in the actuators. Such positional control is very useful in flow choking applications, for example, to precisely regulate production or injection flow between multiple zones and a tubing string.

Note that, in the example of FIG. 7, the conductor 52*b* includes the tubing string 20. This demonstrates that any of the conductors 52 can comprise a tubular string in the well.

Figure 8:
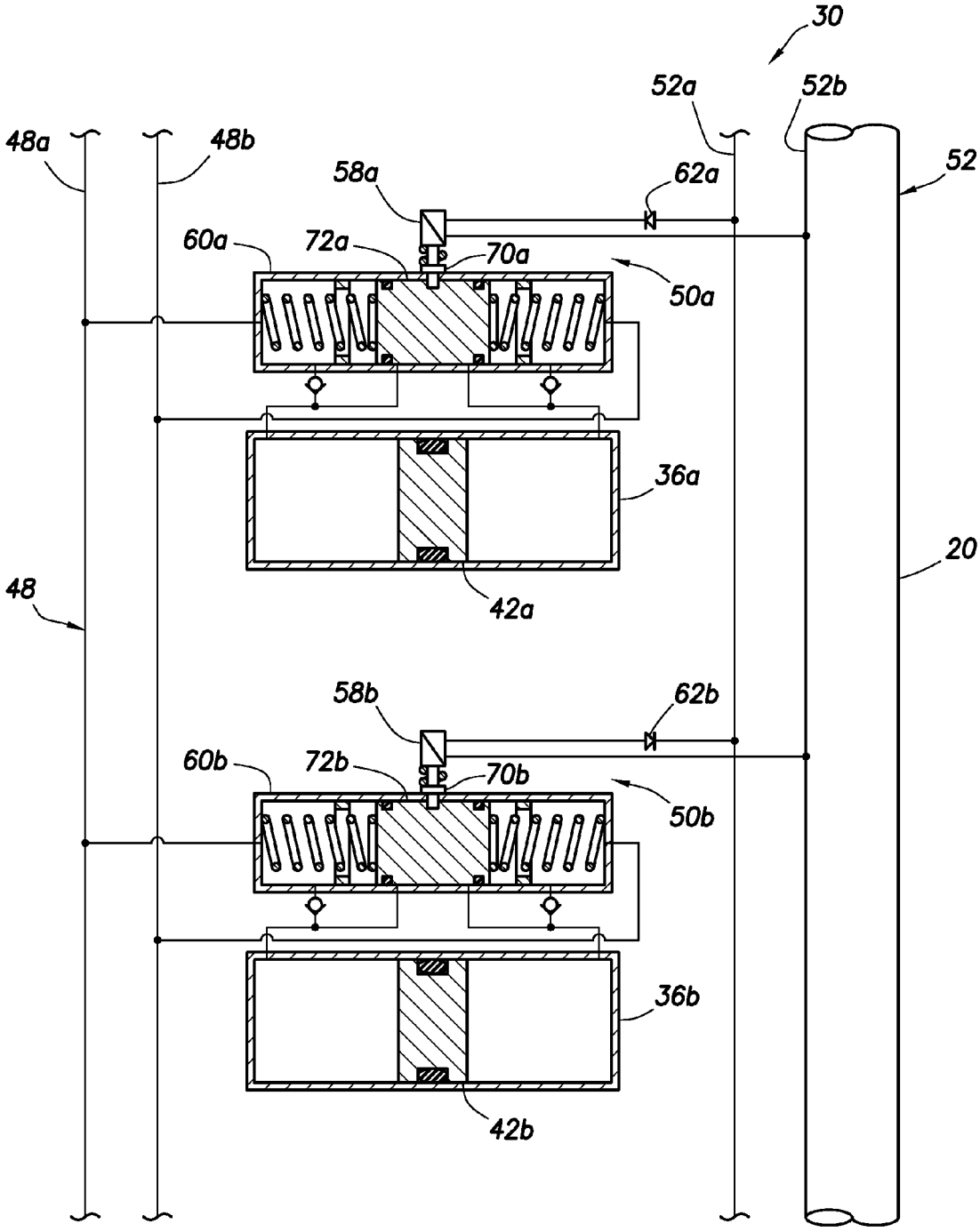
FIG. 8 is a schematic electrical and hydraulic diagram showing another configuration of the system and method for remotely actuating multiple downhole well tools.

Referring additionally now to FIG. 8, another configuration of the control system 30 is representatively illustrated. The configuration of FIG. 8 is similar in many respects to the configuration of FIG. 7, but differs substantially in the manner in which the control devices 50*a,b* operate.

Specifically, the spool valves 60*a,b* are pilot-operated, with the solenoids 58*a,b* serving to selectively permit or prevent such pilot operation. Thus, powering of a respective one of the solenoids 58*a,b* still operates to select a particular one of the well tools 32 for actuation, but the amount of power required to do so is expected to be much less in the FIG. 8 embodiment.

For example, if the solenoid 58*a* is powered by current flow from conductor 52*a* to conductor 52*b*, the solenoid will cause a locking member 70*a* to retract out of locking engagement with a piston 72*a* of the spool valve 60*a*. The piston 72*a* will then be free to displace in response to a pressure differential between the lines 48*a,b*. If, for example, pressure in the line 48*a* is greater than pressure in the line 48*b*, the piston 72*a* will displace to the right, thereby connecting the actuator 36*a* to the pressure source 48, and the piston 42*a* of the actuator 36*a* will displace to the right. However, when the piston 72*a* is in its centered and locked position, the actuator 36*a* is pressure balanced.

Similarly, if the solenoid 58*b* is powered by current flow from conductor 52*b* to conductor 52*a*, the solenoid will cause a locking member 70*b* to retract out of locking engagement with a piston 72*b* of the spool valve 60*b*. The piston 72*b* will then be free to displace in response to a pressure differential between the lines 48*a,b*. If, for example, pressure in the line 48*b* is greater than pressure in the line 48*a*, the piston 72*b* will displace to the left, thereby connecting the actuator 36*b* to the pressure source 48, and the piston 42*b* of the actuator 36*b* will displace to the left. However, when the piston 72*b* is in its centered and locked position, the actuator 36*b* is pressure balanced.

The locking engagement between the locking members 70*a,b* and the pistons 72*a,b* could be designed to release in response to a predetermined pressure differential between the lines 48*a,b* (preferably, a pressure differential greater than that expected to be used in normal operation of the system 30). In this manner, the actuators 36*a,b* could be operated by applying the predetermined pressure differential between the lines 48*a,b*, for example, in the event that one or both of the solenoids 58*a,b* failed to operate, in an emergency to quickly close the flow control devices 38, etc.

Figure 9:
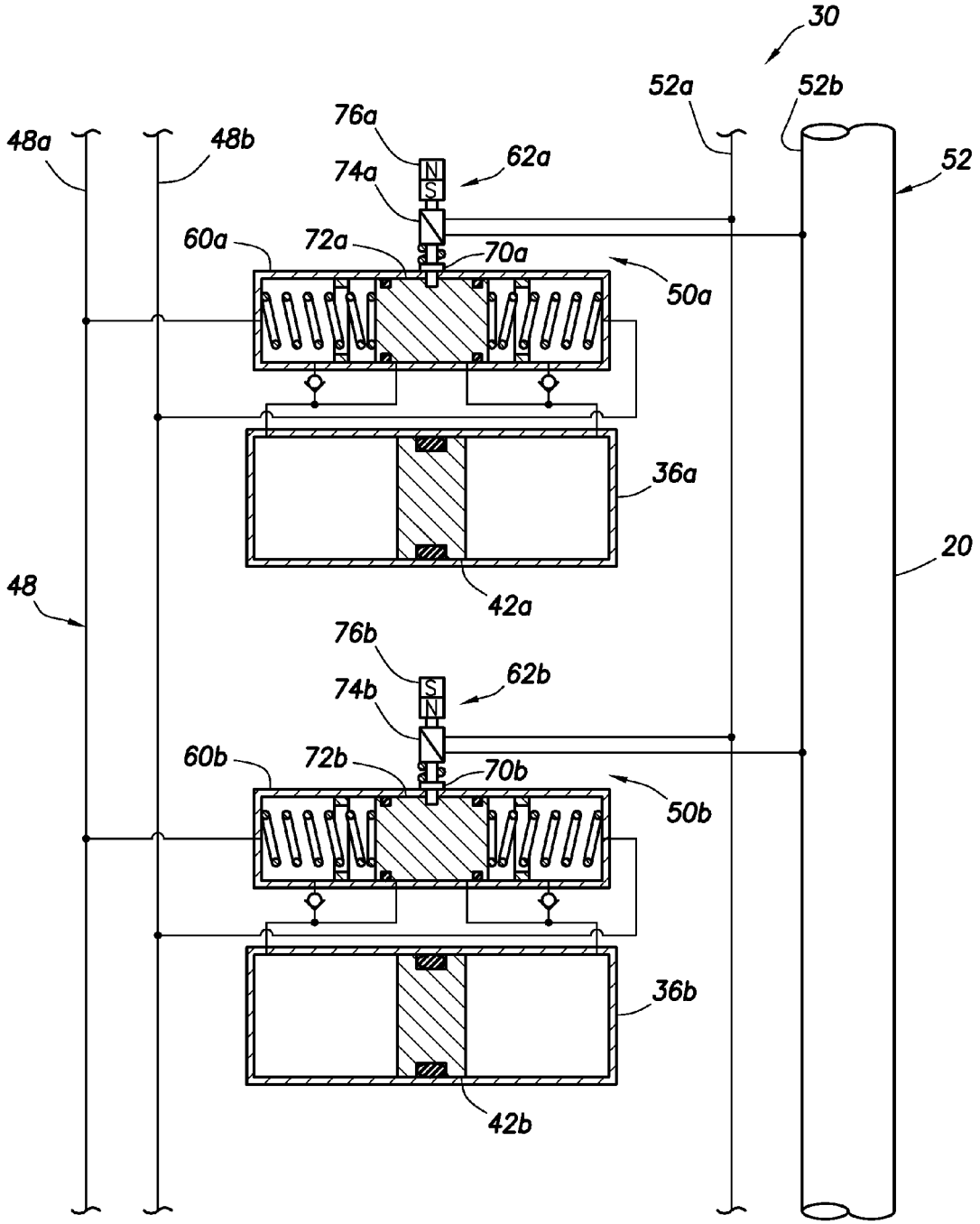
FIG. 9 is a schematic electrical and hydraulic diagram showing another configuration of the system and method for remotely actuating multiple downhole well tools.

Referring additionally now to FIG. 9, another configuration of the control system 30 is representatively illustrated.

The FIG. 9 configuration is similar in many respects to the FIG. 8 configuration, except that the solenoids and diodes are replaced by coils 74*a,b* and magnets 76*a,b* in the control devices 50*a,b* of FIG. 9.

The coils 74*a,b* and magnets 76*a,b* also comprise the directional elements 62*a,b* in the control devices 50*a,b* since the respective locking members 70*a,b* will only displace if current flows between the conductors 52*a,b* in appropriate directions. For example, the coil 74*a* and magnet 76*a* are arranged so that, if current flows from conductor 52*a* to conductor 52*b*, the coil will generate a magnetic field which opposes the magnetic field of the magnet, and the locking member 70*a* will thus be displaced upward (as viewed in FIG. 9) out of locking engagement with the piston 72*a*, and the actuator 36*a* can be connected to the pressure source 48 as described above. Current flow in the opposite direction will not cause such displacement of the locking member 70*a*.

Similarly, the coil 74*b* and magnet 76*b* are arranged so that, if current flows from conductor 52*b* to conductor 52*a*, the coil will generate a magnetic field which opposes the magnetic field of the magnet, and the locking member 70*b* will thus be displaced upward (as viewed in FIG. 9) out of locking engagement with the piston 72*b*, and the actuator 36*b* can be connected to the pressure source 48 as described above. Current flow in the opposite direction will not cause such displacement of the locking member 70*b*.

It will, thus, be appreciated that the FIG. 9 configuration obtains all of the benefits of the previously described configurations, but does not require use of any downhole electrical components, other than the coils 74*a,b* and conductors 52.

Figure 10:
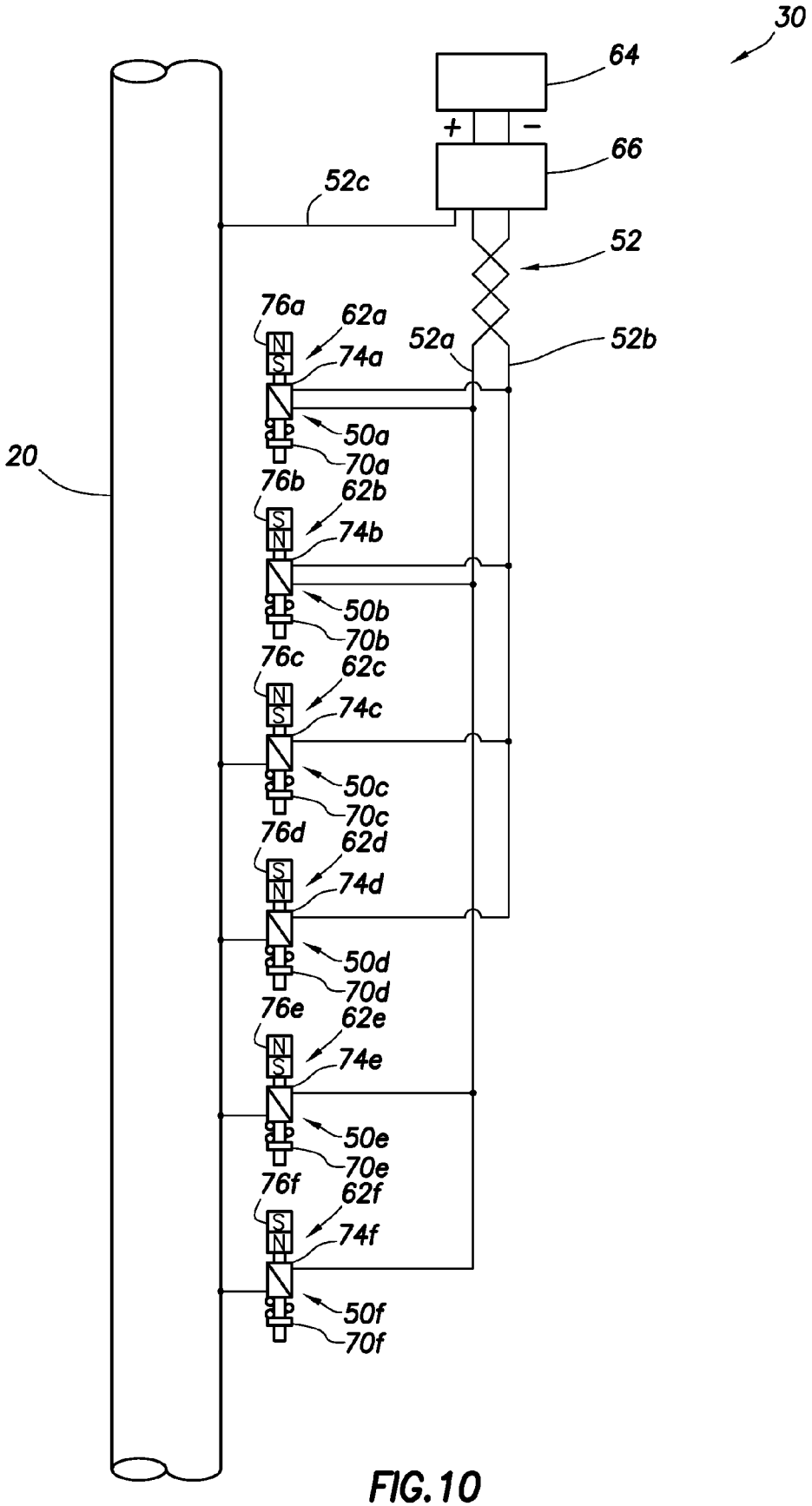
FIG. 10 is a schematic electrical diagram showing another configuration of the system and method for remotely actuating multiple downhole well tools.

Referring additionally now to FIG. 10, another configuration of the control system 30 is representatively illustrated. The FIG. 10 configuration is similar in many respects to the FIG. 9 configuration, but is depicted with six of the control devices 50*a-f* and three sets of the conductors 52, similar to the system 30 as illustrated in FIG. 4. The spool valves 60, actuators 36 and well tools 32 are not shown in FIG. 10 for clarity of illustration and description.

In this FIG. 10 configuration, the coils 74*a-f* and magnets 76*a-f* are arranged so that selected locking members 70*a-f* are displaced in response to current flow in particular directions between certain conductors in the sets of the conductors 52. For example, current flow between the conductors 52*a,b* in one direction may cause the element 62*a* to displace the locking member 70*a* while current flow between the conductors 52*a,b* in an opposite direction may cause the element 62*b* to displace the locking member 70*b*, current flow between the conductors 52*b,c* may cause the element 62*c* to displace the locking member 70*c* while current flow between the conductors 52*b,c* may cause the element 62*d* to displace the locking member 70*d*, and current flow between the conductors 52*a,c* may cause the element 62*e* to displace the locking member 70*e* while current flow between the conductors 52*a,c* in an opposite direction may cause the element 62*f* to displace the locking member 70*f*.

Note that, in each pair of the control devices 50*a,b* 50*c,d* and 50*e,f* connected to the respective sets 52*a,b* 52*b,c* and 52*a,c* of conductors, the magnets 76*a,b* 76*c,d* and 76*e,f* are oppositely oriented (i.e., with their poles facing opposite directions in each pair of control devices). This alternating orientation of the magnets 76*a-f*, combined with the connection of the coils 74*a-f* to particular sets of the conductors 52, results in the capability of selecting a particular well tool 32 for actuation by merely flowing current in a particular direction between particular ones of the conductors.

Figure 11:
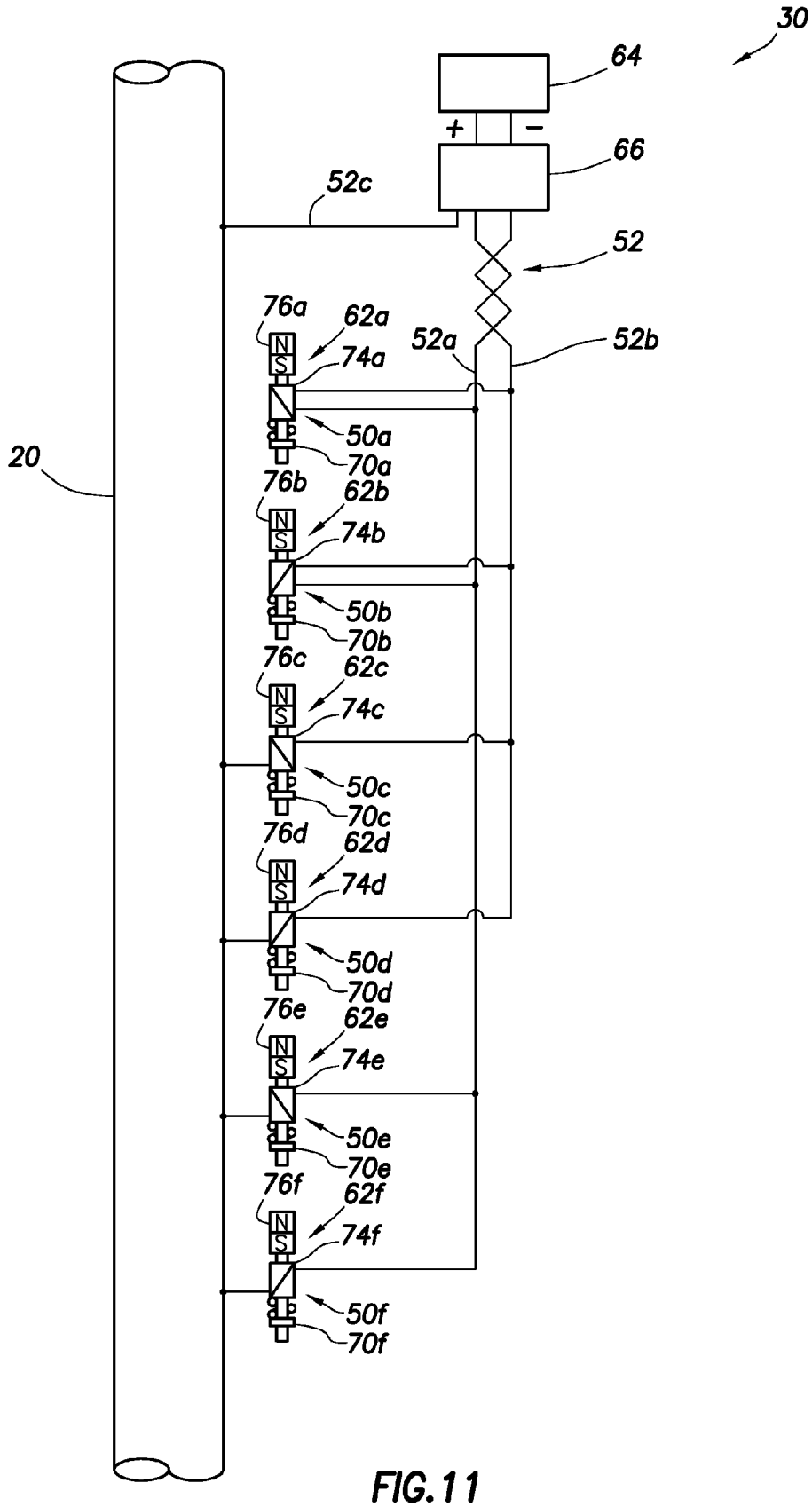
FIG. 11 is a schematic electrical diagram showing another configuration of the system and method for remotely actuating multiple downhole well tools.

Another manner of achieving this result is representatively illustrated in FIG. 11. Instead of alternating the orientation of the magnets 76*a-f* as in the FIG. 10 configuration, the coils 74*a-f* are oppositely arranged in the pairs of control devices 50*a,b* 50*c,d* and 50*e,f*. For example, the coils 74*a-f* could be wound in opposite directions, so that opposite magnetic field orientations are produced when current flows between the sets of conductors.

Another manner of achieving this result would be to oppositely connect the coils 74*a-f* to the respective conductors 52. In this configuration, current flow between a set of conductors would produce a magnetic field in one orientation from one of the coils, but a magnetic field in an opposite orientation from the other one of the coils.

It will, thus, be appreciated that a variety of different configurations can be designed in keeping with the principles of this disclosure while still obtaining the many benefits of these principles. The above description has provided several examples of how these principles can be applied to the problems of selectively actuating multiple well tools, but it should be clearly understood that these principles are not limited to the various examples.

In particular, the above description has provided a method of selectively actuating from a remote location multiple downhole well tools 32 in a well. The method includes the steps of: selecting one of the well tools 32*a* for actuation by flowing electrical current in one direction 54*a* through a set of conductors 52*a,b* in the well; and selecting another one of the well tools 32*b* for actuation by flowing electrical current through the set of conductors 52*a,b* in an opposite direction 54*b*.

The step of selecting the first well tool 32*a* may include providing fluid communication between a source of fluid pressure 48 and an actuator 36*a* of the first well tool 32*a*. The step of selecting the second well tool 32*b* may include providing fluid communication between the source of fluid pressure 48 and an actuator 36*b* of the second well tool 32*b*.

The method may include the step of flowing fluid between the source of fluid pressure 48 and the actuator 36*a* of the first well tool 32*a* for a predetermined period of time through a flow rate regulator 68*a*, thereby displacing a piston 42*a* of the actuator 36*a* of the first well tool 32*a* a predetermined distance. The flow rate regulator 68*a* may substantially maintain a predetermined rate of flow of the fluid as a pressure differential across an input and an output of the flow rate regulator varies over time.

The method may also include the steps of preventing the first well tool 32*a* from actuating while current flows between the conductors 52*a,b* in the second direction, and preventing the second well tool 32*b* from actuating while current flows between the conductors 52*a,b* in the first direction. The step of preventing the first well tool 32*a* from actuating may include using a first diode 62*a* to prevent current flow in the second direction 54*b*, and the step of preventing the second well tool 32*b* from actuating may include using a second diode 62*b* to prevent current flow in the first direction 54*a*.

The method may also include the steps of selecting a third one of the well tools 32 for actuation by flowing electrical current in a third direction through a second set of conductors 52*b,c* in the well; and selecting a fourth one of the well tools 32 for actuation by flowing electrical current through the second set of conductors 52*b,c* in a fourth direction opposite to the third direction.

The above description also provides a system 30 for selectively actuating from a remote location multiple downhole well tools 32 in a well. The system 30 includes multiple electrical conductors 52 in the well and multiple control devices 50 which control which of the well tools 32 is selected for actuation in response to current flow in at least one set of the conductors 52. At least one direction of current flow in the set of conductors 52 is used to select a respective at least one of the well tools 32 for actuation. An opposite direction of current flow in the set of conductors 52 may be used to select a respective other one of the well tools 32 for actuation.

The control devices 50 may include multiple diodes 62. A first one of the diodes 62*a* may be used to permit actuation of a first one of the well tools 32*a* in response to current flow in a first direction between a first set of the conductors 52*a,b*. A second one of the diodes 62*b* may be used to permit actuation of a second one of the well tools 32*b* in response to current flow in a second direction between the first set of the conductors 52*a,b* with the second direction being opposite to the first direction.

The first diode 62*a* may prevent actuation of the first well tool 32*a* when current flows in the second direction between the first set of conductors 52*a,b*. The second diode 62*b* may prevent actuation of the second well tool 32*b* when current flows in the first direction between the first set of conductors 52*a,b*.

The control devices 50 may include multiple coil and magnet sets. A first coil 74*a* and magnet 76*a* set may be used to permit actuation of a first one of the well tools 32*a* in response to current flow in a first direction between a first set of the conductors 52*a,b* and a second coil 74*b* and magnet 76*b* set may be used to permit actuation of a second one of the well tools 32*b* in response to current flow in a second direction between the first set of the conductors 52*a,b* with the second direction being opposite to the first direction.

The first coil 74*a* and magnet 76*a* set may prevent actuation of the first well tool 32*a* when current flows in the second direction between the first set of conductors 52*a,b*. The second coil 74*b* and magnet 76*b* set may prevent actuation of the second well tool 32*b* when current flows in the first direction between the first set of conductors 52*a,b*.

The system 30 may also include at least one hydraulic line 48*a,b* in the well and multiple actuators 36. Each of the actuators 36 may be responsive to fluid pressure in the at least one hydraulic line 48*a,b* to actuate a respective one of the well tools 32. Each of the actuators 36 may be isolated from pressure in the hydraulic line 48*a,b* until the current flow in the set of conductors 52 flows in a respective predetermined direction.

The well tools 32 may include at least first, second, third and fourth well tools, the control devices 50 may include at least first, second, third and fourth control devices, and the sets of conductors 52 may include at least first and second sets of conductors. The first control device 50*a* may be configured to select the first well tool 32*a* for actuation in response to current flow in a first direction between the first set of conductors 52*a,b*, the second control device 50*b* may be configured to select the second well tool 32*b* for actuation in response to current flow between the first set of conductors 52*a,b* in a second direction opposite to the first direction, the third control device 50*c* may be configured to select the third well tool 32*c* for actuation in response to current flow between the second set of conductors 52*b,c* in a third direction, and the fourth control device 50*d* may be configured to select the fourth well tool for actuation in response to current flow between the second set of conductors 52*b,c* in a fourth direction opposite to the third direction.

Telemetry signals may be transmitted via at least one of the conductors 52.

Also provided by the above description is a method of using n conductors 52 to selectively actuate n*(n−1) downhole well tools 32. The method includes the steps of: arranging the n conductors 52 into n*(n−1)/2 sets of conductors; connecting each set of conductors 52 to a respective pair of the well tools 32; and controlling direction of current flow through each set of conductors 52 to thereby selectively actuate the respective pair of the well tools 32.

The controlling step may include selecting a first one of the well tools 32*a* for actuation by flowing electrical current in a first direction between a first one of the sets of conductors 52*a,b*; and selecting a second one of the well tools 32*b* for actuation by flowing electrical current between the first set of conductors 52*a,b* in a second direction opposite to the first direction.

The step of selecting the first well tool 32*a* further comprises providing fluid communication between a source of fluid pressure 48 and an actuator 36*a* of the first well tool 32*a*. The step of selecting the second well tool 32*b* may include providing fluid communication between the source of fluid pressure 48 and an actuator 36*b* of the second well tool 32*b*.

The method may include the step of flowing fluid between the source of fluid pressure 48 and the actuator 36*a* of the first well tool 32*a* for a predetermined period of time through a flow rate regulator 68*a*, thereby displacing a piston 42*a* of the actuator 36*a* of the first well tool 32*a* a predetermined distance.

The method may include the steps of preventing the first well tool 32*a* from actuating while current flows between the conductors 52*a,b* in the second direction, and preventing the second well tool 32*b* from actuating while current flows between the conductors 52*a,b* in the first direction.

The step of preventing the first well tool 32*a* from actuating may include using a first diode 62*a* to prevent current flow in the second direction. The step of preventing the second well tool 32*b* from actuating may include using a second diode 62*b* to prevent current flow in the first direction.

The method may include the steps of selecting a third one of the well tools 32*c* for actuation by flowing electrical current in a third direction between a second set of conductors 52*b,c* in the well; and selecting a fourth one of the well tools for actuation by flowing electrical current between the second set of conductors 52*b,c* in a fourth direction opposite to the third direction.

Note that multiple well tools 32 may be selected for actuation at the same time. For example, multiple similarly configured control devices 50 could be wired in series or parallel to the same set of the conductors 52, or control devices connected to different sets of conductors could be operated at the same time by flowing current in appropriate directions through the sets of conductors.

In addition, note that fluid pressure to actuate the well tools 32 may be supplied by one of the lines 48, and another one of the lines (or another flow path, such as an interior of the tubing string 20 or the annulus 56) may be used to exhaust fluid from the actuators 36. An appropriately configured and connected spool valve can be used, so that the same one of the lines 48 be used to supply fluid pressure to displace the pistons 42 of the actuators 36 in each direction.

Preferably, in each of the above-described embodiments, the fluid pressure source 48 is pressurized prior to flowing current through the selected set of conductors 52 to actuate a well tool 32. In this manner, actuation of the well tool 32 immediately follows the initiation of current flow in the set of conductors 52.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of selectively actuating from a remote location multiple downhole well tools in a well, the method comprising the steps of:

selecting a first one of the well tools for actuation by flowing electrical current in a first direction through a first set of conductors in the well;

selectively controlling a position of a first piston by permitting the first piston to displace at a first predetermined velocity for a first given amount of time, thereby controlling a duration of actuation of the first one of the well tools, and variably actuating the first one of the well tools;

selecting a second one of the well tools for actuation by flowing electrical current through the first set of conductors in a second direction opposite to the first direction; and selectively controlling a position of a second piston by permitting the second piston to displace at a second predetermined velocity for a second given amount of time, thereby controlling a duration of actuation of the second one of the well tools, and variably actuating the second one of the well tools.

2. The method of claim 1, further comprising the steps of preventing the first well tool from actuating while current flows through the conductors in the second direction, and preventing the second well tool from actuating while current flows through the conductors in the first direction.

3. The method of claim 2, wherein the step of preventing the first well tool from actuating further comprises using a first diode to prevent current flow in the second direction, and wherein the step of preventing the second well tool from actuating further comprises using a second diode to prevent current flow in the first direction.

4. The method of claim 1, further comprising the steps of selecting a third one of the well tools for actuation by flowing electrical current in a third direction through a second set of conductors in the well; and selecting a fourth one of the well tools for actuation by flowing electrical current through the second set of conductors in a fourth direction opposite to the third direction.

5. A method of selectively actuating from a remote location multiple downhole well tools in a well, the method comprising the steps of:

selecting a first one of the well tools for actuation by flowing electrical current in a first direction through a first set of conductors in the well; and selecting a second one of the well tools for actuation by flowing electrical current through the first set of conductors in a second direction opposite to the first direction, wherein the step of selecting the first well tool further comprises providing fluid communication between a source of fluid pressure and an actuator of the first well tool;

and wherein the step of selecting the second well tool further comprises providing fluid communication between the source of fluid pressure and an actuator of the second well tool.

6. The method of claim 5, further comprising the step of flowing fluid between the source of fluid pressure and the actuator of the first well tool for a predetermined period of time through a flow rate regulator, thereby displacing a piston of the actuator of the first well tool a predetermined distance.

7. The method of claim 6, wherein the flow rate regulator substantially maintains a predetermined rate of flow of the fluid as a pressure differential across an input and an output of the flow rate regulator varies over time.

8. A system for selectively actuating from a remote location multiple downhole well tools in a well, the system comprising:

multiple electrical conductors in the well;

multiple control devices that control which of the well tools is selected for actuation in response to current flow in at least one set of the conductors, at least one direction of current flow in the at least one set of conductors being operative to select a respective at least one of the well tools for actuation, the control devices selectively controlling a duration of actuation of the at least one of the well tools selected for actuation, thereby variably actuating the at least one of the well tools;

at least one hydraulic line in the well; and multiple actuators, each of the actuators being responsive to fluid pressure in the at least one hydraulic line to actuate a respective one of the well tools.

9. The system of claim 8, wherein the control devices comprise multiple diodes, a first one of the diodes being operative to permit actuation of a first one of the well tools in response to current flow in a first direction through a first set of the conductors, and a second one of the diodes being operative to permit actuation of a second one of the well tools in response to current flow in a second direction through the first set of the conductors, the second direction being opposite to the first direction.

10. The system of claim 9, wherein the first diode prevents actuation of the first well tool when current flows in the second direction through the first set of conductors, and wherein the second diode prevents actuation of the second well tool when current flows in the first direction through the first set of conductors.

11. The system of claim 8, wherein each of the actuators is isolated from pressure in the hydraulic line until the current flow in the set of conductors flows in a respective predetermined direction.

12. The system of claim 8, wherein each of the actuators includes an actuator piston which is pressure balanced until the current flow in the set of conductors flows in a respective predetermined direction.

13. The system of claim 8, wherein the well tools comprise at least first, second, third and fourth well tools, wherein the control devices comprise at least first, second, third and fourth control devices, wherein the sets of conductors comprise at least first and second sets of conductors, and wherein the first control device is configured to select the first well tool for actuation in response to current flow in a first direction through the first set of conductors, the second control device is configured to select the second well tool for actuation in response to current flow through the first set of conductors in a second direction opposite to the first direction, the third control device is configured to select the third well tool for actuation in response to current flow through the second set of conductors in a third direction, and the fourth control device is configured to select the fourth well tool for actuation in response to current flow through the second set of conductors in a fourth direction opposite to the third direction.

14. The system of claim 8, wherein telemetry signals are transmitted via at least one of the conductors.

15. A system for selectively actuating from a remote location multiple downhole well tools in a well, the system comprising:

multiple electrical conductors in the well; and multiple control devices that control which of the well tools is selected for actuation in response to current flow in at least one set of the conductors, at least one direction of current flow in the at least one set of conductors being operative to select a respective at least one of the well tools for actuation, wherein the control devices comprise multiple coil and magnet sets, a first coil and magnet set being operative to permit actuation of a first one of the well tools in response to current flow in a first direction through a first set of the conductors, and a second coil and magnet set being operative to permit actuation of a second one of the well tools in response to current flow in a second direction through the first set of the conductors, the second direction being opposite to the first direction.

16. The system of claim 15, wherein the first coil and magnet set prevents actuation of the first well tool when current flows in the second direction through the first set of conductors, and wherein the second coil and magnet set prevents actuation of the second well tool when current flows in the first direction through the first set of conductors.

17. A method of using n conductors to selectively actuate n*(n−1) downhole well tools, the method comprising the steps of:

arranging the n conductors into n*(n−1)/2 sets of conductors;

connecting each set of conductors to a respective group of the well tools;

controlling direction of current flow through at least one of the sets of conductors, thereby selecting at least one well tool in the respective group of the well tools for actuation, wherein the controlling step further comprises selecting a first one of the well tools for actuation by flowing electrical current in a first direction through a first one of the sets of conductors, and selecting a second one of the well tools for actuation by flowing electrical current through the first set of conductors in a second direction opposite to the first direction, wherein the step of selecting the first well tool further comprises providing fluid communication between a source of fluid pressure and an actuator of the first well tool, and wherein the step of selecting the second well tool further comprises providing fluid communication between the source of fluid pressure and an actuator of the second well tool.

18. The method of claim 17, further comprising the step of flowing fluid between the source of fluid pressure and the actuator of the first well tool for a predetermined period of time through a flow rate regulator, thereby displacing a piston of the actuator of the first well tool a predetermined distance.

19. The method of claim 17, further comprising the steps of preventing the first well tool from actuating while current flows through the conductors in the second direction, and preventing the second well tool from actuating while current flows through the conductors in the first direction.

20. The method of claim 19, wherein the step of preventing the first well tool from actuating further comprises using a first diode to prevent current flow in the second direction, and wherein the step of preventing the second well tool from actuating further comprises using a second diode to prevent current flow in the first direction.

21. The method of claim 17, further comprising the steps of selecting a third one of the well tools for actuation by flowing electrical current in a third direction through a second set of conductors in the well; and selecting a fourth one of the well tools for actuation by flowing electrical current through the second set of conductors in a fourth direction opposite to the third direction.

* * * * *